US010655192B2

(12) United States Patent
Sakakibara et al.

(10) Patent No.: US 10,655,192 B2
(45) Date of Patent: May 19, 2020

(54) HOT-ROLLED STEEL SHEET

(71) Applicant: NIPPON STEEL & SUMITOMO METAL CORPORATION, Tokyo (JP)

(72) Inventors: Akifumi Sakakibara, Oita (JP); Kazuya Ootsuka, Jamshedpur (IN); Takehiro Hoshino, Hiroshima (JP); Teruki Hayashida, Oita (JP); Daisuke Maeda, Futtsu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 160 days.

(21) Appl. No.: 15/511,302

(22) PCT Filed: Sep. 17, 2015

(86) PCT No.: PCT/JP2015/076491
§ 371 (c)(1),
(2) Date: Mar. 15, 2017

(87) PCT Pub. No.: WO2016/043273
PCT Pub. Date: Mar. 24, 2016

(65) Prior Publication Data

US 2017/0253944 A1 Sep. 7, 2017

(30) Foreign Application Priority Data

Sep. 17, 2014 (JP) ..... 2014-188845

(51) Int. Cl.
*C21D 9/46* (2006.01)
*C22C 38/00* (2006.01)
(Continued)

(52) U.S. Cl.
CPC ..... *C21D 9/46* (2013.01); *C22C 38/00* (2013.01); *C22C 38/001* (2013.01);
(Continued)

(58) Field of Classification Search
CPC ..... C21D 2211/001; C21D 2211/002; C21D 2211/005; C21D 2211/008;
(Continued)

(56) References Cited

U.S. PATENT DOCUMENTS 7,381,478 B2 * 6/2008 Yokoi ..... C21D 8/0226 420/8
2009/0139611 A1 6/2009 Kimura et al.
(Continued)

FOREIGN PATENT DOCUMENTS

CN 101326300 A 12/2008
EP 0969112 A1 1/2000
(Continued)

OTHER PUBLICATIONS

International Search Report, issued in PCT/JP2015/076491, PCT/ISA/210, dated Dec. 22, 2015.
Office Action for TW 104130793 dated Apr. 26, 2016.
Korean Office Action dated Apr. 9, 2018, issued in Korean Patent Application No. 10-2017-7007583.
Extended European Search Report for correspondog European Application No. 15843007.4, dated Jan. 23, 2018.
(Continued)

*Primary Examiner* — Veronica F Faison
(74) *Attorney, Agent, or Firm* — Birch, Stewart, Kolasch & Birch, LLP

(57) ABSTRACT

A hot-rolled steel sheet including predetermined components, in which the amounts of Cr and Al added satisfy Expression (1) below, a metallographic structure has, by % by volume, a ferrite fraction of more than 90% and 98% or less, a martensite fraction of 2% to less than 10%, and, a fraction of a residual structure made of one or more of pearlite, bainite, and residual austenite being less than 1%, the ferrite has an average circle-equivalent diameter of 4 μm or more and a maximum circle-equivalent diameter of 30 μm
(Continued)

or less, and the martensite has an average circle-equivalent diameter of 10 μm or less and a maximum circle-equivalent diameter of 20 μm or less.

$$[Cr]\times 5+[Al]\geq 0.50 \quad \text{Expression (1)}$$

Here, in Expression (1), [Cr] represents an amount of Cr (mass %), and [Al] represents an amount of Al (mass %).

6 Claims, 1 Drawing Sheet

(51) Int. Cl.

| | |
|---|---|
| ***C22C 38/60*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/42*** | (2006.01) |
| ***C22C 38/58*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/42* (2013.01); *C22C 38/58* (2013.01); *C22C 38/60* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C21D 2211/009; C21D 9/46; C22C 38/00; C22C 38/001; C22C 38/002; C22C 38/005; C22C 38/02; C22C 38/04; C22C 38/06; C22C 38/20; C22C 38/22; C22C 38/24; C22C 38/26; C22C 38/28; C22C 38/32; C22C 38/38; C22C 38/42; C22C 38/58; C22C 38/60
See application file for complete search history.

(56) References Cited

U.S. PATENT DOCUMENTS

| | | | | |
|---|---|---|---|---|
| 2013/0032253 | A1 | 2/2013 | Kariya et al. | |
| 2014/0000769 | A1* | 1/2014 | Takahashi | C21D 8/0226 148/602 |
| 2014/0234655 | A1* | 8/2014 | Takashima | C23C 2/02 428/659 |
| 2015/0219249 | A1* | 8/2015 | Shinohara | C22C 38/001 428/586 |

FOREIGN PATENT DOCUMENTS

| | | | |
|---|---|---|---|
| EP | 1559797 | A1 | 8/2005 |
| EP | 2460903 | A1 | 6/2012 |
| JP | 2001-303187 | A | 10/2001 |
| JP | 2004-52104 | A | 2/2004 |
| JP | 2005-240172 | A | 9/2005 |
| JP | 2005-298896 | A | 10/2005 |
| JP | 2006-152341 | A | 6/2006 |
| JP | 2008-19502 | A | 1/2008 |
| JP | 2010-126747 | A | 6/2010 |
| JP | 2011-225955 | A | 11/2011 |
| JP | 2013-19048 | A | 1/2013 |
| JP | 2013-122072 | A | 6/2013 |
| JP | 2014-141703 | A | 8/2014 |
| WO | WO 2014/051005 | A1 | 4/2014 |

OTHER PUBLICATIONS

Chinese Office Action and Search Report for counterpart Application No. 201580049547.3, dated Dec. 4, 2017, with an English translation of the Search Report.

* cited by examiner

HOT-ROLLED STEEL SHEET

TECHNICAL FIELD OF THE INVENTION

The present invention relates to a hot-rolled steel sheet. The present invention particularly relates to a high-strength hot-rolled steel sheet which is preferable for car suspension members and the like and has excellent surface properties, shape fixability, hole expansibility, and fatigue resistance.

Priority is claimed on Japanese Patent Application No. 2014-188845, filed in Japan on Sep. 17, 2014, the content of which is incorporated herein by reference.

RELATED ART

In order to decrease the emission amount of carbonate gas exhausted from cars, weight reduction of car bodies by using high-strength steel sheets is underway. The above-described demand for high-strengthening also applies to structural members or suspension members which account for approximately 20% of the body weight of automobiles. High-strength hot-rolled steel sheets are also continuously applied to these members.

However, generally, the high-strengthening of steel sheets deteriorates their material properties such as formability (workability). Therefore, it becomes a key factor in the development of high-strength steel sheets to find a proper method for high-strengthening without causing any deterioration of material properties. Particularly, as properties required for steel sheets for structural members or suspension members, workability and shape fixability during press forming and, additionally, fatigue durability during use is important. It is important to balance a high strength and the above-described properties at a high level.

Furthermore, in addition to balancing the material properties of steel sheet at a high level as described above, there is another demand in a variety of fields for realizing a high added value as products from users' viewpoint. For example, for steel sheets used for wheel disks, in order to cope with a necessity of a high designability of aluminum wheels, there is a demand for designability (surface properties) for steel sheet surfaces and burring properties (hole expansibility) favorable enough to withstand working into complicated shapes.

Generally, as high-strength hot-rolled steel sheet used as steel sheets for suspension members, dual phase steel (DP steel) having a structure made of ferrite and martensite is used.

DP steel has excellent strength and elongation and, furthermore, also has excellent fatigue resistance because of the presence of a hard layer. Therefore, DP steel is suitable for hot-rolled steel sheets used for car suspension components. However, DP steel generally contains a large amount of Si, which is a ferrite-stabilizing element, in order to form a structure including ferrite as a primary body. Therefore, DP steel is a kind of steel which is likely to form a defect called a Si scale pattern on steel sheet surfaces. Therefore, DP steel has poor designability for steel sheet surfaces and is generally used for components that are placed inside cars and are thus invisible.

Furthermore, DP steel structure which includes both soft phase ferrite and hard phase martensite, and thus deteriorates hole expansibility due to the difference in hardness between these two phases. Therefore, at the moment, DP steel has a problem in imparting a high added value as products which are demanded by users.

There is a method for improving designability for steel sheet surfaces. For example, Patent Document 1 discloses a method in which descaling is carried out in a state in which the temperature of a steel piece after rough-rolling is increased, thereby manufacturing steel sheets having substantially no Si scale on the surface.

However, in the above-described method, there is a problem in that the temperature after finish-rolling increases as the temperature of the steel piece after rough-rolling increases, grain diameters are coarsened, and properties such as strength, toughness, and fatigue properties deteriorate. In addition, there is still a possibility that the Si scale pattern emerges after pickling even when there is no Si scale after rolling since the Si scale pattern is generated in the following manner: Si scale is generated, Si scale-generated portions deteriorate the degree of roughness of the surface of a pickled steel sheet, and the shape emerges due to the difference in the degree of roughness between the Si scale-generated portions and normal portions.

In consideration of what has been described above, in order to remove the Si scale pattern on steel sheet surfaces and improve designability, it is necessary to prevent the generation of Si scale. In the method of Patent Document 1, it is considered that designability for steel sheet surfaces cannot be fully improved.

There is a method for manufacturing DP steel having improved surface properties of steel sheets by limiting the amount of Si added. For example, Patent Document 2 discloses a method for manufacturing a high-strength thin steel sheet having excellent workability and surface properties in which the equiaxial ferrite volume percentage is 60% or more and the martensite volume percentage is 5% to 30%.

In the invention described in Patent Document 2, ferrite-generating elements are limited. As a result, in the manufacturing method, cooling is initiated within two seconds after completing the hot-rolling, and a steel sheet is cooled at 750° C. to 600° C. at a cooling rate of 150° C./s or more, is held in a temperature range of 750° C. to 600° C. for 2 to 15 seconds, is cooled at a cooling rate of 20° C./s or more, and is coiled at a temperature of 400° C. or lower. Therefore, in the method of Patent Document 2, the driving force for the generation of ferrite is increased, and a large generation amount of ferrite is ensured, thereby realizing both excellent surface properties and workability.

However, when the cooling rate after finish-rolling is 150° C./s or more, not only ferritic transformation but also pearlitic transformation occur earlier. Therefore, it becomes difficult to obtain a high ferrite fraction, and the fraction of hard phases such as martensite or pearlite which deteriorate hole expansibility increases.

That is, in the method of Patent Document 2, DP steel having excellent surface properties can be manufactured, but it is not possible to impart excellent hole expansibility.

Meanwhile, means for improving the hole expansibility of DP steel is known. For example, Patent Document 3 discloses a method in which ferrite is sufficiently generated, and a hard second phase (martensite) is finely dispersed a small fraction, thereby manufacturing steel sheets having excellent elongation and hole expansibility.

However, in Patent Document 3, in order to sufficiently generate ferrite and finely disperse a small fraction of martensite, the total amount of Si and Al, which are ferrite-stabilizing elements, is set to 0.1% or more. Furthermore, in Patent Document 3, Al is used as a subsidiary element, and a large amount of Si is added. Therefore, Si scale is generated on steel sheet surfaces, and the deterioration of designability is expected.

That is, in the method of Patent Document 3, it is not possible to realize both favorable hole expansibility and designability for steel sheet surfaces.

In addition, there is a method for improving the hole expansibility of DP steel with no need for ensuring the generation amount of ferrite by the addition of ferrite-stabilizing elements. For example, Patent Document 4 discloses a method for manufacturing DP steel having excellent hole expansibility by decreasing the difference in hardness between two phases of ferrite and martensite.

Generally, as a method for decreasing the difference in hardness between two phases of ferrite and martensite, strengthening of soft phases by means of the precipitation strengthening of ferrite and softening of hard phases by means of the tempering of martensite are known. However, in the former method, there is a concern that shape taxability during press forming may be deteriorated in order to increase yield strength. Regarding the latter method, it is difficult to carry out tempering in the middle of the existing hot-rolling processes, and special devices such as heating devices are separately required, and thus the latter method is poorly feasible and is not desirable from the viewpoint of manufacturing efficiency and manufacturing costs. In addition, even when special devices such as heating devices are installed, in the latter method, there is a possibility that fatigue properties may be deteriorated due to the softening of hard phases.

As described above, it has been difficult to manufacture hot-rolled steel sheets having favorable hole expansibility and favorable designability for steel sheet surfaces (excellent surface properties) by balancing high strength, shape fixability and fatigue resistance at a high level.

PRIOR ART DOCUMENT

Patent Document

[Patent Document 1] Japanese Unexamined Patent Application Publication No. 2006-152341

[Patent Document 2] Japanese Unexamined Patent Application Publication No. 2005-240172

[Patent Document 3] Japanese Unexamined Patent Application Publication No. 2013-019048

[Patent Document 4] Japanese Unexamined Patent Application Publication No. 2001-303187

DISCLOSURE OF THE INVENTION

Problems to be Solved by the Invention

The present invention has been made in consideration of the above-described problems, and an object of the present invention is to provide a hot-rolled steel sheet having excellent surface properties, shape fixability, hole expansibility, and fatigue resistance.

Means for Solving the Problem

The present inventors optimized the components and manufacturing conditions of high-strength hot-rolled steel sheets and controlled the structures of steel sheets. As a result of such efforts, the present inventors succeeded the manufacturing of a high-strength hot-rolled steel sheet having no Si scale patterns on the surface, having excellent fatigue resistance, and having excellent shape fixability and hole expansibility.

Aspects of the present invention are as follows:

[1] A hot-rolled steel sheet according to an aspect of the present invention including:

by mass %,

C: 0.02% to 0.20%;

Si: more than 0% to 0.15%;

Mn: 0.5% to 2.0%;

P: more than 0% to 0.10%;

S: more than 0% to 0.05%;

Cr: 0.05% to 0.5%;

Al: 0.01% to 0.5%;

N: more than 0% to 0.01%;

Ti: 0% to 0.20%;

Nb: 0% to 0.10%;

Cu: 0% to 2.0%;

Ni: 0% to 2.0%;

Mo: 0% to 1.0%;

V: 0% to 0.3%;

Mg: 0% to 0.01%;

Ca: 0% to 0.01%;

REM: 0% to 0.1%; and

B: 0% to 0.01%, with a remainder consisting of Fe and impurities, in which amounts of Cr and Al added satisfy Expression (1) below, wherein a metallographic structure has, by % by volume, a ferrite fraction of more than 90% and 98% or less, a martensite fraction of 2% to less than 10%, and, furthermore, a fraction of a residual structure made of one or more of pearlite, bainite, and residual austenite being less than 1%, the ferrite has an average circle-equivalent diameter of 4 μm or more and a maximum circle-equivalent diameter of 30 μm or less, and the martensite has an average circle-equivalent diameter of 10 μm or less and a maximum circle-equivalent diameter of 20 μm or less:

$$[Cr]\times 5+[Al]\geq 0.50 \qquad \text{Expression (1)}$$

here, in Expression (1), [Cr] represents an amount of Cr (mass %), and [Al] represents an amount of Al (mass %).

[2] The hot-rolled steel sheet according to [1], further including:

by mass %, one or two of

Ti: 0.02% to 0.20%; and

Nb: 0.005% to 0.10%.

[3] The hot-rolled steel sheet according to [1] or [2], further including:

by mass %, one or more of

Cu: 0.01% to 2.0%;

Ni: 0.01% to 2.0%;

Mo: 0.01% to 1.0%; and

V: 0.01% to 0.3%.

[4] The hot-rolled steel sheet according to any one of [1] to [3], further including:

by mass %, one or more of

Mg: 0.0005% to 0.01%;

Ca: 0.0005% to 0.01%; and

REM: 0.0005% to 0.1%.

[5] The hot-rolled steel sheet according to any one of [1] to [3], further including:

by mass %,

B: 0.0002% to 0.01%.

Effects of the Invention

According to the above-described aspect of the present invention, it is possible to provide a hot-rolled steel sheet having no Si scale pattern on the surface, that is, having excellent surface properties and having excellent fatigue resistance, shape fixability, and hole expansibility.

EMBODIMENTS OF THE INVENTION

Figure 1:
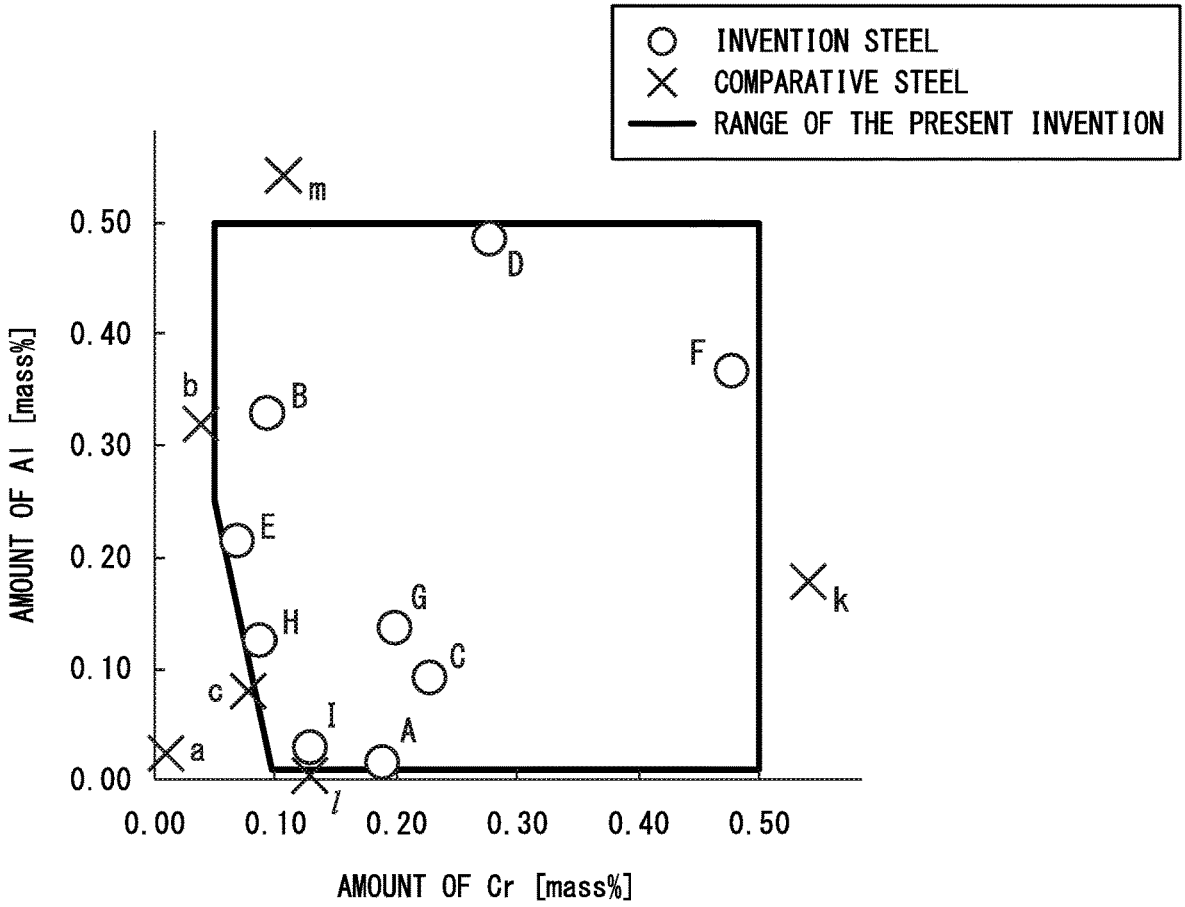
FIG. 1 is a graph showing a relationship between an amount of Cr and an amount of Al for obtaining a desired microstructure specified by the present invention.

Hereinafter, a hot-rolled steel sheet according to an embodiment of the present invention will be described.

First, the study results by the present inventors and new findings obtained from the study results which lead to an idea of the present invention will be described.

As a result of intensive studies, the present inventors found that, when the amount of Si in steel is set to 0.15% or less (zero is not included), and, in the metallographic structure, by % by volume, the ferrite fraction is set to more than 90% and 98% or less, the martensite fraction is set to 2% or more and less than 10%, the average circle-equivalent diameter and maximum circle-equivalent diameter of ferrite are set to 4 μm or more and 30 μm or less respectively, and the average circle-equivalent diameter and maximum circle-equivalent diameter of martensite are set to 10 μM or less and 20 μm or less respectively, in hot-rolled steel sheets, it is possible to ensure excellent surface properties not causing Si scale patterns on surfaces, excellent fatigue resistance and shape fixability, favorable hole expansibility, and high strength.

Next, the metallographic structure (microstructure) of a hot-rolled steel sheet of the present embodiment will be described.

In the hot-rolled steel sheet according to the present embodiment, ferrite is included as a primary phase, the volume percentage of ferrite is set to more than 90% and 98% or less, and the average circle-equivalent diameter of ferrite is set to 4 μm or more. In such a case, favorable elongation, which is workability required during press forming, is imparted, and the yield ratio is limited, whereby excellent shape fixability can be obtained. In order to further improve elongation and shape fixability, it is preferable to set the volume percentage of ferrite to 92% or more and the average circle-equivalent diameter to 6 μm or more. Meanwhile, the upper limit of the average circle-equivalent diameter of ferrite is not particularly limited, but is preferably set to 15 μm or less from the viewpoint of hole expansibility.

In addition, when the maximum circle-equivalent diameter of ferrite is set to more than 30 μm, it is not possible to ensure sufficient hole expansibility. Therefore, the maximum circle-equivalent diameter of ferrite needs to be set to 30 μm or less. In order to further improve hole expansibility, the maximum circle-equivalent diameter of ferrite is preferably set to 20 μm or less. Meanwhile, the lower limit of the maximum circle-equivalent diameter of ferrite is not particularly limited, but is preferably set to 10 μm or more from the viewpoint of shape fixability.

In the metallographic structure of the steel sheet according to the present embodiment, in addition to the ferrite, martensite is included as a second phase, the volume percentage of martensite is set to 2% or more and less than 10%, and the average circle-equivalent diameter and maximum circle-equivalent diameter of martensite are set to 10 μm or less and 20 μm or less respectively. In such a case, it is possible to ensure excellent maximum tensile strength and hole expansibility, and, furthermore, a high fatigue limit ratio.

Martensite is a hard metallographic structure and is effective for ensuring strength. When the fraction of martensite is less than 2%, it is not possible to ensure a sufficient maximum tensile strength. Therefore, the martensite fraction is set to 2% or more and preferably set to 3% or more. However, when the martensite fraction is 10% or more, strain concentration caused by working occurs in the boundary between hard martensite and soft metallographic structures, and it is not possible to ensure sufficient hole expansibility. Therefore, the martensite fraction is set to less than 10% and preferably set to 8% or less.

In addition, when the circle-equivalent diameter of martensite coarsens, martensite fractures due to strain concentration, and hole expansibility are deteriorated. Therefore, the average circle-equivalent diameter of martensite and the maximum circle-equivalent diameter of martensite are set to 10 μm or less and 20 μm or less respectively. In order to further improve hole expansibility, it is preferable to set the average circle-equivalent diameter of martensite to 5 μm or less and the maximum circle-equivalent diameter to 10 μm or less. Meanwhile, the lower limits of the average circle-equivalent diameter and maximum circle-equivalent diameter of martensite are not particularly limited, but are preferably set to 2 μm or more and 5 μm or more respectively from the viewpoint of ensuring strength or fatigue resistance.

Furthermore, the hot-rolled steel sheet according to the present embodiment may contain, as the metallographic structure of the remainder, a residual structure of one or more of bainite, pearlite, and residual austenite as long as the total volume percentage thereof is less than 1%. The fraction of the residual structure is preferably low. When the volume percentage of the residual structure is 1% or more, strength decreases, and fatigue durability deteriorates. Therefore, the volume percentage of the residual structure needs to be limited to less than 1%. From the viewpoint of ensuring strength or fatigue resistance, the volume percentage of the residual structure may be 0%.

Here, in the present embodiment, for the identification of ferrite, martensite, and the residual structure which constitute the metallographic structure and the measurement of the area fractions and the circle-equivalent diameters, the reagent disclosed in Japanese Unexamined Patent Application Publication No. S59-219473 is used.

Regarding the measurement specimen, a sheet thickness cross-section parallel to a rolling direction is sampled as an observed surface from a location at a point of ¼ or ¾ of the total width of the steel sheet. The observation surface is ground and is etched with the reagent disclosed in Japanese Unexamined Patent Application Publication No. S59-219473, and a location of ¼ or ¾ of the sheet thickness is observed using an optical microscope, thereby carrying out image processing. The area fractions of ferrite and martensite are measured in the above-described manner. In the present embodiment, the average value of the area fractions measured at ten visual fields in a 160 μm×200 μm region at a magnification of 500 times is used as the area fraction of ferrite or martensite.

In addition, similarly, the cross-sectional areas of grains of ferrite and martensite are measured respectively by means of image processing, and, with an assumption that all of the grains have a circular shape, the circle-equivalent diameter of ferrite or martensite can be inversely computed from the areas. In the present embodiment, the average value of all of the computed circle-equivalent diameters measured at ten visual fields at a magnification of 500 times is used as the average circle-equivalent diameter of ferrite or martensite. The largest one of all of the computed circle-equivalent diameters is used as the maximum circle-equivalent diameter of ferrite or martensite.

Next, the reasons for limiting the chemical components of the hot-rolled steel sheet of the present embodiment will be described. Meanwhile, "%" indicating the amounts of the respective elements refers to "mass %".

<C: 0.02% to 0.20%>

C is an element necessary to obtain the above-described desired microstructure. However, when more than 0.20% of C is included, workability and weldability deteriorate, and thus the amount of C is set to 0.20% or less. The more preferred amount of C is 0.15% or less. In addition, when the amount of C is less than 0.02%, the martensite fraction reaches less than 2%, and the strength decreases. Therefore, the amount of C is set to 0.02% or more. The more preferred amount of C is 0.03% or more.

<Si: More than 0% to 0.15%>

Si needs to be limited in order to prevent the properties of the steel sheet surface from being deteriorated. When more than 0.15% of S is included, Si scale is generated on the steel sheet surface during hot-rolling, and the properties of the pickled steel sheet surface may be significantly deteriorated. Therefore, the amount of Si needs to be set to 0.15% or less. The amount of Si is desirably limited to 0.10% or less and more desirably limited to 0.08% or less. Meanwhile, the lower limit of the amount of S is set to more than 0% since S inevitably intrudes into the steel sheet during manufacturing.

<Mn: 0.5% to 2.0%>

Mn is added to make the second phase structure of the steel sheet martensite by means of quenching strengthening in addition to solid solution strengthening. Even when more than 2.0% of Mn is added, this effect is saturated, and thus the upper limit of the amount of Mn is set to 2.0%. On the other hand, when the amount of Mn is less than 0.5%, an effect of suppressing pearlitic transformation or bainitic transformation during cooling is not easily exhibited. Therefore, the amount of Mn is 0.5% or more and desirably 0.7% or more.

<P: More than 0% to 0.10%>

P is an impurity included in hot metal, and the lower limit of the amount of P is set to more than 0%. P is an element which segregates in grain boundaries and degrades workability or fatigue properties as the amount of P increases. Therefore, the amount of P is desirably small. When more than 0.10% of P is included, the workability or fatigue properties and, furthermore, weldability are also adversely affected. Therefore, the amount of P is limited to 0.10% or less and preferably limited to 0.08% or less.

<S: More than 0% to 0.05%>

S is an impurity included in hot metal, and the lower limit of the amount of S is set to more than 0%. S is an element which does not only cause cracking during hot-rolling but also generates inclusions such as MnS, which deteriorates hole expansibility, when the amount of S is too high. Therefore, the amount of S is supposed to be extremely decreased. However, as long as the amount of S is 0.05% or less, the effects of the present invention are not impaired, and the amount of S is in the allowable range, and thus the amount of S is limited to 0.05% or less. However, in a case in which hole expansibility are further ensured, the amount of S is preferably limited to 0.03% or less and more preferably limited to 0.01% or less.

<Cr: 0.05% to 0.5%>

<Al: 0.01% to 0.5%>

<[Cr]×5+[Al]≥0.50>

Cr is required to obtain the above-described desired microstructure. The inclusion of Cr suppresses the formation of iron-based carbides and thus suppresses pearlitic transformation and bainitic transformation after ferritic transformation. Furthermore, Cr enhances hardenability and thus enables martensitic transformation. Therefore, Cr is an important element for balancing the strength, elongation, hole expansibility, and fatigue properties of the steel sheet at a high level. These effects cannot be obtained when the amount of Cr is less than 0.05%. On the other hand, when the amount of Cr exceeds 0.5%, the effects are saturated. Therefore, the amount of Cr is set to 0.05% or more and 0.5% or less. In order to further develop the above-described effects, the amount of Cr is preferably set to 0.06% or more.

Al accelerates ferritic transformation, furthermore, suppresses the formation of coarse cementite, and improves workability. Al is required to impart excellent hole expansibility and fatigue properties and, furthermore, shape fixability to the hot-rolled steel sheet of the present embodiment. In addition, Al is also available as a deoxidizing material. However, the excess addition of Al increases the number of Al-based coarse inclusions and causes the deterioration of hole expansibility and surface damages. Therefore, the upper limit of the amount of Al is set to 0.5%. A preferred amount of Al is 0.4% or less. On the other hand, when the amount of Al is less than 0.01%, an effect of accelerating ferritic transformation cannot be obtained, and thus the amount of Al needs to be set to 0.01% or more. The more preferred amount of Al is 0.05% or more.

Furthermore, in the hot-rolled steel sheet of the present embodiment, the amount of Cr contributing to martensitic transformation and the amount of Al accelerating ferritic transformation satisfy Expression (1) below. It is important for the amounts of Cr and Al to satisfy the expression since it becomes possible to manufacture high-strength hot-rolled steel sheets having excellent fatigue resistance and having excellent shape fixability and hole expansibility.

FIG. 1 shows a relationship between the amount of Cr "mass %" and the amount of Al "mass %" for obtaining the desired microstructure specified by the present invention. In the graph of FIG. 1, "X" indicates comparative steel incapable of obtaining the desired microstructure.

As is clear from the graph of FIG. 1, when predetermined amounts or more of Cr and Al are added so as to satisfy Expression (1) below, it is possible to increase the average value of the circle-equivalent diameters of ferrite and, additionally, decrease the circle-equivalent diameters of martensite, and thus the high-strength hot-rolled steel sheet of the present embodiment having excellent shape fixability and hole expansibility can be obtained. Meanwhile, in order to further develop this effect, the left side ([Cr]×5+[Al]) of Expression (1) below is preferably set to 0.70 or more.

$$[Cr]\times 5+[Al]\geq 0.50 \qquad \text{Expression (1)}$$

The reasons therefor are not absolutely clear; however, according to the present inventors, are assumed as described below.

First, since the addition of the predetermined amount (being 0.01% to 0.5% and satisfying Expression (1)) of Al improves the transformation point, it is possible to initiate ferritic transformation at a higher temperature. Therefore, ferrite grains grow, the average value of the circle-equivalent diameters of the ferrite grains increases, and the yield stress (0.2% proof stress) decreases. Therefore, the yield ratio decreases, and the hot-rolled steel sheet has excellent shape fixability. Furthermore, due to the improvement of the transformation point, the transformation is capable of initiating before austenite coarsens by means of grain growth. Therefore, ferritic transformation becomes possible at a larger number of nucleation sites, and residual austenite after ferritic transformation finely disperses. When the steel sheet is quenched at this time, it is considered that martensite having a small circle-equivalent diameter can be obtained. However, Al only has a weak effect of suppressing the generation of iron-based carbides and allows the generation of pearlite or generates bainite without being quenched. Therefore, a sufficient martensite fraction cannot be obtained. Therefore, when Cr as well as Al is added as much as 0.05% to 0.5% and Expression (1) is satisfied, as described above, the generation of iron-based carbides is suppressed, and it is possible to enhance hardenability. That is, when the actions of Al and Cr are combined together, martensite having a small circle-equivalent diameter can be obtained, and hot-rolled steel sheets having favorable hole expansibility can be obtained.

Therefore, high-strength hot-rolled steel sheets having no Si scale pattern on the surface, having excellent fatigue resistance, and having excellent shape fixability and hole expansibility can be manufactured by adjusting the amounts of these two elements. That is, in the present invention, it is important to satisfy Expression (1). In addition, to DP steel of the related art, it is common to add Si, and Si is capable of realizing the effects exhibited by Al and Cr. Therefore, in the related art, it is considered to be impossible to confirm the above-described effect of the combined addition of Al and Cr.

<N: More than 0% to 0.01%>

N is an impurity element, and the lower limit of the amount of N is set to more than 0. When the amount of N exceeds 0.01%, coarse nitrides are formed, and bendability or hole expansibility are deteriorated. Therefore, the upper limit of the amount of N is limited to 0.01% or less. In addition, when the amount of N increases, blow holes are generated during welding. Therefore, the amount of N is preferably decreased. The lower limit of the amount of N is desirably small and is not particularly specified. Since the amount of N being set to less than 0.0005% increases manufacturing costs, the amount of N is preferably set to 0.0005% or more.

<Ti: 0% to 0.20%>

<Nb: 0% to 0.10%>

The lower limit values of the amounts of Ti and Nb are 0%. Ti and Nb are elements that form carbides and precipitation-strengthen ferrite. However, when more than 0.10% of Nb is added, ferritic transformation is significantly delayed, and elongation is deteriorated. Therefore, the upper limit of the amount of Nb is preferably set to 0.10%. In addition, when more than 0.20% of Ti is added, ferrite is excessively strengthened, and favorable elongation cannot be obtained. Therefore, the upper limit of the amount of Ti is preferably set to 0.20%. Meanwhile, in order to strengthen ferrite, 0.005% or more of Nb and 0.02% or more of Ti need to be added respectively.

<Cu: 0% to 2.0%>

<Ni: 0% to 2.0%>

<Mo: 0% to 1.0%>

<V: 0% to 0.3%>

The lower limit values of the amounts of Cu, Ni, Mo, and V are 0%. Cu, Ni, Mo, and V are elements having an effect of increasing the strength of hot-rolled steel sheets by means of precipitation strengthening or solid solution strengthening, and any one or more of these may be added. The above-described effect is saturated when the amount of Cu is more than 2.0%, the amount of Ni is more than 2.0%, the amount of Mo is more than 1.0%, and the amount of V is more than 0.3%, and thus the inclusion of these elements of the above-described amounts is not preferred from the viewpoint of manufacturing costs. Therefore, in a case in which Cu, Ni, Mo, and V are added as necessary, the amount of Cu is preferably set to 2.0% or less, the amount of Ni is preferably set to 2.0% or less, the amount of Mo is preferably set to 1.0% or less, and the amount of V is preferably set to 0.3% or less. Meanwhile, in a case in which Cu, Ni, Mo, and V are added as necessary, when the amounts thereof are too small, it is not possible to sufficiently obtain the above-described effect. Therefore, in a case in which Cu, Ni, Mo, and V are added, the amount of Cu is preferably set to 0.01% or more, the amount of Ni is preferably set to 0.01% or more, the amount of Mo is preferably set to 0.01% or more, and the amount of V is preferably set to 0.01% or more.

<Mg: 0% to 0.01%>

<Ca: 0% to 0.01%>

<REM: 0% to 0.1%>

The lower limits of the amounts of Mg, Ca, and REM are 0%. Mg, Ca, and REM (rare earth elements) are elements which serve as the starting point of fracture, control the form of non-metallic inclusions causing the deterioration of workability, and improve workability. However, the above-described effect is saturated when the amount of Mg is more than 0.01%, the amount of Ca is more than 0.01%, and the amount of REM is more than 0.1%, and thus the inclusion of these elements of the above-described amounts is not preferred from the viewpoint of manufacturing costs. Therefore, in a case in which Mg, Ca, and REM are added as necessary, the amount of Mg is desirably set to 0.01% or less, the amount of Ca is desirably set to 0.01% or less, and the amount of REM is desirably set to 0.1% or less. Meanwhile, in order to control the form of non-metallic inclusions and improve workability, 0.0005% or more of Mg, 0.0005% or more of Ca, and 0.0005% or more of REM need to be added.

<B: 0% to 0.01%>

The lower limit value of the amount of B is 0%. In the present embodiment, in addition to the above-described composition, B may be added in order for high-strengthening. However, there are cases in which B deteriorates formability when excessively included. Therefore, the upper limit of the amount of B is preferably set to 0.01%. Meanwhile, in order to obtain the effect of high-strengthening, 0.0002% or more 13 needs to be added.

Meanwhile, in the present embodiment, the remainder other than the above-described elements is made of Fe and impurities. Examples of the impurities include impurities included in raw materials such as mineral ores, scrap, and the like, and impurities added during manufacturing steps.

In addition, as the impurity, for example, O forms non-metallic inclusions and has an adverse influence on qualities, and thus the amount of O is desirably decreased to 0.003% or less.

In addition, the present embodiment may contain a total of 1% of less of Zr, Sn, Co, Zn, and W in addition to the above-described elements. However, Sn has a concern of generating defects during hot-rolling, and thus, in the case of being included, the amount of Sn is desirably 0.05% or less.

Meanwhile, in the high-strength hot-rolled steel sheet of the present embodiment, it is possible to improve corrosion resistance by providing a plated layer such as a hot-dip galvanized layer obtained by a hot-dip galvanizing treatment or, furthermore, a zinc alloy-plated (galvannealed) layer obtained by an alloying treatment after a galvanizing treatment on the surface of the hot-rolled steel sheet described above.

In addition, the plated layer does not need to be a pure zinc layer and may contain elements such as Si, Mg, Zn, Al, Fe, Mn, Ca, and Zr so as to further improve corrosion resistance. The provision of the above-described plated layer does not impair the excellent fatigue resistance, shape fixability, and hole expansibility of the hot-rolled steel sheet of the present embodiment.

Furthermore, the hot-rolled steel sheet of the present embodiment may have any of surface-treated layers obtained by the formation of an organic membrane, a film lamination, an organic salt/inorganic salt treatment, a non-chromate treatment, or the like. Even when these surface-treated layers are provided, the effects of the hot-rolled steel sheet of the present embodiment can be sufficiently obtained without being impaired.

Next, a method for manufacturing the high-strength hot-rolled steel sheet of the present embodiment described above will be described.

In order to realize hot-rolled steel sheets having excellent surface properties, fatigue resistance and shape fixability, and favorable hole expansibility and high strength, as described above, the metallographic structure is important. In the metallographic structure, the ferrite fraction is set to more than 90% and 98% or less, the martensite fraction is set to 2% to less than 10%, the fraction of the residual structure made of one or more of pearlite, bainite, and residual austenite is set to less than 1%, the average circle-equivalent diameter and maximum circle-equivalent diameter of ferrite are set to 4 μm or more and 30 μM or less respectively, and the average circle-equivalent diameter and maximum circle-equivalent diameter of martensite are set to 10 μM or less on an average and 20 μm or less respectively. The details of manufacturing conditions for satisfying what has been described above at the same time will be described.

The manufacturing method preceding hot-rolling is not particularly limited. That is, subsequent to melting using a blast furnace, an electric furnace, or the like, a variety of secondary smelting processes are carried out so that the components are adjusted as described above. Next, it is necessary to carry out ordinary continuous casting, casting using an ingot method, and, additionally, casting using a method such as thin slab casting. In the case of continuous casting, the steel sheet may be hot-rolled after being cooled to a low temperature and then heated again. An ingot may be hot-rolled without being cooled to room temperature. Alternatively, a casting slab may be continuously hot-rolled. Scrap may be used as a raw material as long as the components can be controlled to be in the range of the present embodiment.

The high-strength hot-rolled steel sheet of the present embodiment having excellent surface properties, hole expansibility, and shape fixability and having excellent fatigue resistance can be obtained in a case in which the following requirements are satisfied.

That is, in the manufacturing of the high-strength steel sheet, the steel sheet is melted to the predetermined steel sheet components described above, and a casting slab is cooled directly or after being cooled, and heating, thereby completing rough-rolling. For the obtained rough-rolled specimen, the end temperature of finish-rolling is set to 800° C. to 950° C., cooling is initiated within two seconds after completing the finish-rolling, and the specimen is cooled to a first temperature range of 600° C. to 750° C. at an average cooling rate of 50° C./s to less than 150° C./s. After that, the specimen is held in a second temperature range of the cooling end temperature or lower and 550° C. or higher for two seconds to 20 seconds in a state of the cooling rate being 0° C./s to 10° C./s, then, is cooled from the cooling end temperature to 300° C. at an average cooling rate of 50° C./s or more, and is coiled at 300° C. or lower. Therefore, high-strength hot-rolled steel sheets having excellent surface properties, hole expansibility, and shape fixability and having excellent fatigue resistance can be manufactured.

The finish-rolling end temperature needs to be set to 800° C. to 950° C.

In the high-strength hot-rolled steel sheet of the present embodiment, hole expansibility are enhanced when the ferrite fraction in the structure is set to more than 90% to 98%. However, in a case in which the finish-rolling end temperature exceeds 950° C., ferritic transformation is delayed, and a ferrite fraction of more than 90% cannot be ensured. In addition, in a case in which the finish-rolling end temperature is lower than 800° C., transformation occurs in the middle of rolling, and an inhomogeneous structure is formed. As a result, it becomes difficult for the steel sheet to have favorable hole expansibility. Therefore, the finish-rolling end temperature is set to 800° C. to 950° C. Preferably, the finish-rolling end temperature is set to 820° C. to 930° C.

Cooling is initiated within two seconds after completing the finish-rolling, and specimen is cooled to the first temperature range of 600° C. to 750° C. at an average cooling rate of 50° C./s to less than 150° C./s. After that, the specimen is held in a second temperature range of the cooling end temperature or lower and 550° C. or higher for two seconds to 20 seconds in a state of the cooling rate being 0° C./s to 10° C./s.

In a case in which longer than two seconds elapses after completing the finish-rolling to the initiation of the cooling and/or a case in which the average cooling rate to the first temperature range is less than 50° C./s, austenite grain diameters before transformation are coarsened. Therefore, it is not possible to set the circle-equivalent diameter of martensite to 10 μm or less on average and 20 μm or less at maximum. Additionally, since ferritic transformation is delayed, it becomes difficult to ensure a ferrite fraction of more than 90%. Therefore, cooling is initiated within two seconds after completing the finish-rolling, and the average cooling rate to the first temperature range is set to 50° C./s or more. Preferably, the average cooling rate is set to 70° C./s or more. On the other hand, when the average cooling rate to the first temperature range is set to 150° C./s or more, pearlitic transformation occurs earlier, and thus it is not possible to ensure a ferrite fraction of more than 90%. As a result, it becomes difficult to manufacture hot-rolled steel sheets having favorable hole expansibility. Therefore, the average cooling rate to the first temperature range is set to less than 150° C./s and preferably set to 130° C./s or less.

In addition, in a case in which the upper limit temperature of the first temperature range is higher than 750° C. and/or a case in which the holding time (cooling time) in the second temperature range is shorter than two seconds as well, it is not possible to ensure a ferrite fraction of more than 90%. Therefore, the first temperature range is set to 750° C. or lower, and the holding time in the second temperature range is set to two seconds or longer. A preferred upper limit temperature is 720° C. or lower, and the holding time is five seconds or longer. However, when the holding time exceeds 20 seconds, pearlite is generated, and thus it is not possible to ensure a martensite fraction of 2% or more. Therefore, the holding time in the second temperature range is set to 20 seconds or shorter and preferably set to 15 seconds or shorter.

Furthermore, in a case in which the lower limit temperature of the first temperature range is lower than 600° C., it is not possible to set the circle-equivalent diameter of ferrite to 4 μm or more on average and 30 μm or less on maximum, and high-strength hot-rolled steel sheets having excellent shape fixability cannot be manufactured. Therefore, the lower limit of the first temperature range is set to 600° C. or higher. A preferred lower limit temperature of the first temperature range is 650° C. or higher.

As described above, it is important that cooling is initiated within two seconds after completing the finish-rolling, the specimen is cooled to the first temperature range of 600° C. to 750° C. at an cooling rate of 50° C./s to less than 150° C./s, furthermore, after that, the specimen is held in the second temperature range of the cooling end temperature or lower and 550° C. or higher for two seconds to 20 seconds in a state of the cooling rate being 0° C./s to 10° C./s.

Next, after being held (cooled) in the second temperature range, the specimen is cooled from the holding (cooling) end temperature to 300° C. at an average cooling rate of 50° C./s or more. When the average cooling rate from the second temperature range holding (cooling) end temperature to 300° C. is less than 50° C./s, bainitic transformation cannot be avoided, it is not possible to ensure a martensite fraction of 2% or more, and excellent fatigue properties cannot be obtained. Preferably, the average cooling rate from the holding (cooling) end temperature to 300° C. is 60° C./s or more. Meanwhile, the upper limit of the average cooling rate from the holding (cooling) end temperature to 300° C. is not particularly limited, but is preferably set to 100° C./s or less from the viewpoint of avoiding the introduction of strain into ferrite.

Coiling after the cooling of the hot-rolled steel sheet needs to be carried out at 300° C. or lower. This is because it is necessary to transform the secondary phase in the metallographic structure to martensite. Since bainite is generated at a coiling temperature of higher than 300° C., it is not possible to ensure 2% or more of martensite, and excellent fatigue properties cannot be obtained. Preferably, the coiling temperature is set to 270° C. or lower.

As a result, the high-strength hot-rolled steel sheet of the present embodiment can be manufactured.

Meanwhile, for the purpose of correction of the steel sheet shape or improvement in ductility by the introduction of moving dislocations, it is desirable to carry out skin-pass rolling with a reduction of 0.1% to 2% after the end of all steps.

In addition, after the end of all steps, pickling may be carried out on the obtained hot-rolled steel sheet as necessary for the purpose of removing scale attached to the surface of the obtained hot-rolled steel sheet. Furthermore, after the pickling, skin-pass or cold-rolling may be carried out on the obtained hot-rolled steel sheet in-line or off-line with a reduction of 10% or less.

In addition, after the coiling, a galvanizing treatment may be carried out as necessary. For example, a hot-dip galvanized layer obtained by a hot-dip galvanizing treatment or, furthermore, a zinc alloy-plated (galvannealed) layer obtained by an alloying treatment after a galvanizing treatment may be formed.

Furthermore, a surface-treated layer obtained by the formation of an organic membrane, a film lamination, an organic salt/inorganic salt treatment, a non-chromate treatment, or the like may be formed on the surface of the hot-rolled steel sheet.

EXAMPLE

Hereinafter, the technical contents of the present invention will be further described with reference to examples of the present invention. Meanwhile, conditions in the examples described below are examples of conditions for confirming the feasibility and effects of the present invention. The present invention is not limited to these condition examples. In addition, the present invention is allowed to employ a variety of conditions within the scope of the gist of the present invention as long as the object of the present invention is achieved.

As the examples, study results obtained using steels A to I shown in Table 1 which satisfy the component composition of the present invention (invention steels) and steels a to f which do not satisfy the component composition of the present invention (comparative steels) will be described.

All of the invention steels and the comparative steels were cast, then, were reheated immediately or after being cooled to room temperature, and were roughly rolled. After that, the obtained rough-rolled specimens were hot-rolled under conditions shown in Table 2 and were cooled, air-cooled, and coiled under conditions shown in Table 2, thereby producing hot-rolled steel sheets all having a sheet thickness of 3.4 mm.

Meanwhile, on some of the hot-rolled steel sheets, skin-pass rolling was carried out before pickling with a reduction in a range of 0.3% to 2.0%.

After that, for the obtained steel sheets A-1 to I-1 and a-1 to f-1, the following properties were evaluated.

JIS No. 5 test specimens were cut out in a direction perpendicular to the rolling direction, tensile tests were carried out according to JIS Z 2241, and the yield stress (YP), the maximum tensile strength (TS), and the yield ratio (YR) were obtained. Meanwhile, test specimens having a maximum tensile strength of 590 MPa or more in the tensile test were evaluated as having "high strength". In addition, test specimens having a yield ratio of 80% or less were evaluated as "having excellent shape fixability".

The hole expansion value (λ) was measured using the hole expansion test method described in Japan Iron and Steel Federation Standard JFS T1001-1996. Meanwhile, test specimens having a hole expansion value λ of 80% or higher were evaluated as having "excellent hole expansibility".

Figure 2:
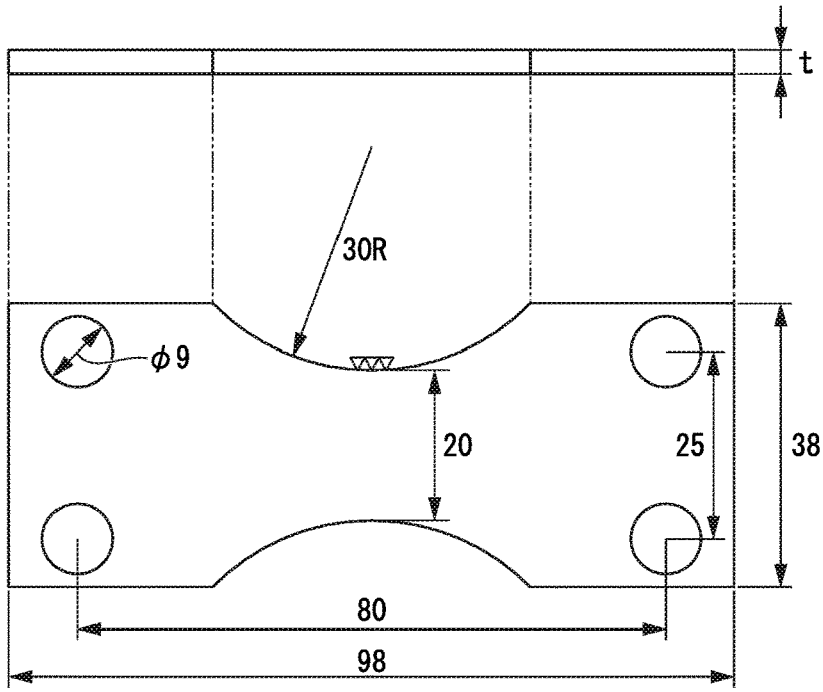
FIG. 2 is a schematic view showing the shape of a plane bending fatigue test specimen used in the present example.

The fatigue limit ratio was computed as a value obtained by carrying out a completely-reversed plane bending fatigue test on a plane bending fatigue test specimen and dividing the fatigue strength at the $2\times10^6$ cycle by the maximum tensile strength TS of the steel sheet. As the plane bending fatigue test specimen, a specimen having a length of 98 mm, a width of 38 mm, a minimum cross-sectional portion with a width of 20 mm, notches with a radius of curvature of 30 mm, and a sheet thickness t remaining unchanged after rolling as shown in FIG. 2 was used.

Meanwhile, test specimens having a fatigue limit ratio of 0.45 or more were evaluated as "having excellent fatigue resistance".

In addition, in order to evaluate the surface properties of the steel sheets, whether or not Si scale pattern were formed on the steel sheet surface was visually observed.

In addition, regarding the formability (workability) of the hot-rolled steel sheet according to the present invention, test specimens having an elongation (El) obtained from the tensile test of 24% or higher were evaluated as having excellent formability.

Regarding some of the hot-rolled steel sheets shown in Table 3, the hot-rolled steel sheets were heated to 660° C. to 720° C. and were subjected to a hot-dip galvanizing treatment so as to produce hot-dip galvanized steel sheets (GI), and then material tests were carried out. Alternatively, an alloying thermal treatment was carried out at 540° C. to 580° C. after the hot-dip galvanizing treatment so as to produce galvannealed steel sheets (GA), and then material tests were carried out. "HR" in Table 3 indicates hot-rolling which had not been subjected to a plating treatment.

Microstructural observation was carried out using the above-described method, and the volume percentages (fractions) of the respective structures, and the average circle-equivalent diameters and maximum circle-equivalent diameters of ferrite and martensite were measured. Meanwhile, the "residual structure fraction" in the table indicates the volume percentage of the structure made of one or more of pearlite, bainite, and residual austenite. In addition, regarding the "residual structure fraction" in the table, the expression of "<1" indicates that the measurement result of the residual structure fraction is less than 1% and an extremely small amount of the residual structure is included.

The above-described results are shown in Table 3.

Only steel sheets satisfying the conditions of the present invention had excellent surface properties and shape fixability, had excellent hole expansibility and fatigue resistance, and were capable of obtaining a high strength.

On the other hand, in Steel A-3 in which the finish-rolling end temperature reached 950° C. or higher, ferritic transformation was delayed. Therefore, in spite of the other hot-rolling conditions being set in the range of the present invention, it was not possible to set the structure fractions in the range of the present invention, the elongation and the fatigue properties were poor, and the shape fixability was poor.

In Steel A-4, longer than two seconds elapsed from completing the finish-rolling to the initiation of the cooling. Therefore, austenite grain diameters excessively coarsened, and furthermore, ferritic transformation was delayed, and thus the average circle-equivalent diameter of margensite being obtained increased. As a result, the hole expansibility deteriorated.

In Steel A-5, the average cooling rate from the initiation of the cooling after the finish-rolling to the first temperature range was slow. Therefore, ferritic transformation could not be accelerated, and it was not possible to concentrate C in austenite, and thus the steel sheet was not favorably quenched in the subsequent cooling, and a coarse secondary phase was generated. Therefore, the fatigue properties and the shape fixability deteriorated.

In Steel B-2, the set temperature of the first temperature range was too low, it was not possible to set the average circle-equivalent diameter of ferrite to 4 μm or more, and the elongation and the shape fixability deteriorated.

In Steel B-3, the holding (cooling) time in the second temperature range was shorter than two seconds, it was not possible to ensure a sufficient generation amount of ferrite, and C could not be concentrated in austenite. Therefore, the steel sheet was not favorably quenched in the subsequent cooling, and a coarse secondary phase was generated. Therefore, the fatigue properties and the shape fixability deteriorated.

In Steel C-2, the finish-rolling end temperature was as low as 796° C., and ferritic transformation occurred in the middle of rolling. Therefore, the rolling became two-phase region rolling, the structure became inhomogeneous, and the maximum circle-equivalent grain diameter of ferrite exceeded 30 μM. Therefore, the hole expansibility deteriorated.

In Steel E-2, the average cooling rate near 300° C. from the holding end temperature in the second temperature range was as slow as 38° C./s, the secondary phase structure was not quenched, and martensite could not be obtained, and thus the fatigue properties deteriorated.

In Steel E-3, the coiling temperature was as high as 311° C., and martensite could not be obtained in the secondary phase structure. Therefore, the strength deteriorated, and furthermore, the fatigue properties and the shape fixability deteriorated.

In Steel G-2, the average cooling rate from the initiation of the cooling after the finish-rolling to the initiation of the cooling in the second temperature range was as fast as 169° C./s, and the steel sheet was partially supercooled. Therefore, a desired structure could not be obtained, and the hole expansibility deteriorated.

In addition, as described in Steels A-2, H-1, and I-1, the material quality of the present invention can be ensured even when a hot-dip galvanizing treatment or a hot-dip galvanizing treatment and an alloying thermal treatment is carried out.

On the other hand, Steels a to fin which the steel sheet components did not satisfy the range of the present invention do not have any Si scale on the steel sheet surface and, furthermore, are not capable of manufacturing high-strength hot-rolled steel sheets having a maximum tensile strength of 590 MPa or more, a yield ratio of 80% or more, an elongation of 24% or more, hole expansibility of 80% or more, and additionally, a fatigue limit ratio of 0.45 or higher.

Steel g was a specimen in which the amount of carbon (C) was set to be below the range of the present invention, but martensite could not be ensured as shown in Table 3, and Steel h was a specimen in which the amount of Mn was set to be above the range of the present invention, but the martensite fraction became excessive as shown in Table 3. Steel k was a specimen in which the amount of Cr was set to be above the range of the present invention, but the martensite fraction became excessive as shown in Table 3. In Steel 1, the amount of Al was below the range of the present invention, and ferrite was insufficient as shown in Table 3. In Steel m, the amount of Al was above the range of the present invention, and thus the hole expansibility deteriorated as shown in Table 3.

TABLE 1

| Steel | C | Si | Mn | P | S | Cr | Al | Cr × 5 + Al | N | Others | Note |
|---|---|---|---|---|---|---|---|---|---|---|---|
| | Chemical components (mass %) | | | | | | | | | | |
| A | 0.100 | 0.06 | 1.53 | 0.013 | 0.003 | 0.19 | 0.014 | 0.964 | 0.0028 | — | Invention Steel |
| B | 1.037 | 0.04 | 0.97 | 0.010 | 0.002 | 0.10 | 0.326 | 0.801 | 0.0015 | Nb = 0.010, Ti = 0.037 | Invention Steel |
| C | 0.048 | 0.05 | 0.98 | 0.016 | 0.003 | 0.23 | 0.091 | 1.241 | 0.0034 | Nb = 0.013, Ti = 0.043 | Invention Steel |
| D | 0.065 | 0.07 | 1.38 | 0.011 | 0.004 | 0.28 | 0.484 | 1.884 | 0.0022 | Mo = 0.02, B = 0.0009 | Invention Steel |
| E | 0.092 | 0.10 | 1.62 | 0.003 | 0.003 | 0.07 | 0.214 | 0.564 | 0.0018 | Cu = 0.07, Ni = 0.05 | Invention Steel |
| F | 0.191 | 0.04 | 0.91 | 0.030 | 0.005 | 0.48 | 0.366 | 2.766 | 0.0029 | Ti = 0.021, Ca = 0.0023 | Invention Steel |
| G | 0.061 | 0.14 | 1.17 | 0.006 | 0.005 | 0.20 | 0.135 | 1.135 | 0.0026 | V = 0.046 | Invention Steel |
| H | 0.089 | 0.02 | 1.73 | 0.022 | 0.001 | 0.09 | 0.123 | 0.573 | 0.0014 | Mg = 0.0014 | Invention Steel |
| I | 0.063 | 0.03 | 1.30 | 0.026 | 0.004 | 0.13 | 0.028 | 0.678 | 0.0030 | REM = 0.0038 | Invention Steel |
| J | 0.063 | 0.03 | 1.30 | 0.026 | 0.004 | 0.13 | 0.028 | 0.678 | 0.0030 | REM = 0.0038 | Invention Steel |
| a | 0.060 | 0.05 | 1.07 | 0.012 | 0.003 | 0.01 | 0.022 | 0.072 | 0.0023 | Nb = 0.011, Ti = 0.045 | Comparative Steel |
| b | 0.045 | 0.10 | 1.65 | 0.014 | 0.005 | 0.04 | 0.318 | 0.518 | 0.0031 | — | Comparative Steel |
| c | 0.094 | 0.02 | 1.05 | 0.018 | 0.003 | 0.08 | 0.079 | 0.479 | 0.0046 | — | Comparative Steel |
| d | 0.210 | 0.05 | 0.92 | 0.005 | 0.003 | 0.20 | 0.051 | 1.051 | 0.0031 | — | Comparative Steel |
| e | 0.042 | 0.17 | 1.66 | 0.020 | 0.002 | 0.17 | 0.138 | 0.988 | 0.0040 | — | Comparative Steel |
| f | 0.150 | 0.15 | 0.43 | 0.011 | 0.002 | 0.14 | 0.132 | 0.832 | 0.0026 | — | Comparative Steel |
| g | 0.018 | 0.13 | 1.87 | 0.009 | 0.006 | 0.15 | 0.058 | 0.808 | 0.0029 | — | Comparative Steel |
| h | 0.097 | 0.05 | 2.19 | 0.220 | 0.001 | 0.11 | 0.158 | 0.708 | 0.0034 | — | Comparative Steel |
| k | 0.122 | 0.10 | 1.53 | 0.019 | 0.005 | 0.53 | 0.191 | 2.841 | 0.0022 | — | Comparative Steel |
| l | 0.107 | 0.14 | 1.12 | 0.013 | 0.002 | 0.13 | 0.009 | 0.659 | 0.0031 | — | Comparative Steel |
| m | 0.059 | 0.08 | 1.34 | 0.025 | 0.003 | 0.10 | 0.540 | 1.040 | 0.0019 | — | Comparative Steel |

Underlined values indicate that the values are outside the range of the present invention.

25

TABLE 2

| Steel | Finish-rolling end temperature (° C.) | Time from completing finish-rolling to the initiation of cooling (seconds) | Average cooling rate from the initiation of cooling after finish-rolling to first temperature range (° C./s) | Cooling initiation temperature in second temperature range (° C.) | Cooling time in second temperature range (seconds) | Average cooling rate from cooling end temperature in second temperature range to 300° C. (° C./s) | Coiling temperature (° C.) | Presence and absence of skin-pass | Note |
|---|---|---|---|---|---|---|---|---|---|
| | Hot-rolling conditions | | | | | | | | |
| A-1 | 820 | 1.5 | 130 | 622 | 10.2 | 71 | Room temperature | Present | Invention Steel |
| A-2 | 847 | 1.9 | 112 | 617 | 10.5 | 74 | 227 | Absent | Invention Steel |
| A-3 | 963 | 1.1 | 120 | 709 | 7.2 | 54 | 183 | Absent | Comparative Steel |
| A-4 | 817 | 3.1 | 87 | 749 | 7.7 | 63 | 149 | Present | Comparative Steel |
| A-5 | 862 | 1.6 | 45 | 681 | 10.1 | 66 | Room temperature | Present | Comparative Steel |
| B-1 | 851 | 1.1 | 136 | 750 | 4.6 | 64 | Room temperature | Present | Invention Steel |
| B-2 | 885 | 1.5 | 82 | 585 | 6.1 | 68 | 194 | Absent | Comparative Steel |
| B-3 | 884 | 1.3 | 76 | 632 | 1.6 | 73 | 180 | Present | Comparative Steel |
| C-1 | 850 | 1.3 | 93 | 710 | 8.9 | 58 | Room temperature | Absent | Invention Steel |
| C-2 | 796 | 1.8 | 74 | 700 | 2.9 | 63 | Room temperature | Present | Comparative Steel |
| D-1 | 839 | 1.8 | 88 | 716 | 13.8 | 64 | 112 | Present | Invention Steel |
| E-1 | 879 | 1.1 | 144 | 646 | 14.1 | 65 | Room temperature | Absent | Invention Steel |
| E-2 | 854 | 2.0 | 109 | 647 | 10.8 | 38 | 171 | Absent | Comparative Steel |
| E-3 | 866 | 1.0 | 103 | 739 | 8.6 | 67 | 311 | Present | Comparative Steel |
| F-1 | 892 | 1.4 | 50 | 659 | 5.5 | 51 | 122 | Present | Invention Steel |
| G-1 | 877 | 1.0 | 131 | 618 | 12.5 | 62 | Room temperature | Present | Invention Steel |
| G-2 | 924 | 1.9 | 169 | 602 | 8.6 | 75 | Room temperature | Absent | Comparative Steel |
| H-1 | 853 | 1.4 | 125 | 638 | 10.4 | 64 | 261 | Present | Invention Steel |
| I-1 | 842 | 1.0 | 105 | 695 | 12.1 | 60 | 135 | Present | Invention Steel |
| a-1 | 870 | 1.5 | 108 | 638 | 12.9 | 61 | Room temperature | Present | Comparative Steel |
| b-1 | 891 | 1.3 | 75 | 621 | 8.8 | 66 | Room temperature | Present | Comparative Steel |
| c-1 | 918 | 1.9 | 143 | 623 | 12.4 | 71 | Room temperature | Absent | Comparative Steel |
| d-1 | 945 | 1.2 | 59 | 685 | 12.3 | 74 | Room temperature | Present | Comparative Steel |
| e-1 | 925 | 1.6 | 129 | 707 | 7.3 | 73 | Room temperature | Present | Comparative Steel |
| f-1 | 839 | 1.2 | 104 | 699 | 11.6 | 60 | Room temperature | Absent | Comparative Steel |
| g-1 | 879 | 1.8 | 123 | 732 | 9.1 | 52 | Room temperature | Present | Comparative Steel |
| h-1 | 808 | 1.9 | 116 | 616 | 15.6 | 64 | Room temperature | Present | Comparative Steel |
| k-1 | 853 | 1.3 | 108 | 633 | 14 | 54 | Room temperature | Present | Comparative Steel |
| l-1 | 859 | 1.8 | 121 | 671 | 10 | 59 | Room temperature | Present | Comparative Steel |
| m-1 | 920 | 1.2 | 104 | 737 | 3 | 51 | Room temperature | Absent | Comparative Steel |

Underlined values indicate that the values are outside the range of the present invention.

TABLE 3

Microstructure and mechanical properties

| Steel | Steel kind* | Ferrite fraction (%) | Martensite fraction (%) | Residual structure fraction (%) | Average circle-equivalent diameter of ferrite (μm) | Maximum circle-equivalent diameter of ferrite (μm) | Average circle-equivalent diameter of martensite (μm) |
|---|---|---|---|---|---|---|---|
| A-1 | HR | 96 | 4 | 0 | 7 | 11 | 5 |
| A-2 | GI | 94 | 6 | 0 | 6 | 13 | 7 |
| A-3 | HR | 76 | 3 | 21 | 10 | 15 | 4 |
| A-4 | HR | 90 | 10 | 0 | 13 | 25 | 12 |
| A-5 | HR | 82 | 7 | 11 | 11 | 20 | 5 |
| B-1 | HR | 97 | 3 | 0 | 9 | 17 | 5 |
| B-2 | HR | 97 | 3 | 0 | 3 | 5 | 2 |
| B-3 | HR | 89 | 2 | 9 | 8 | 18 | 9 |
| C-1 | HR | 96 | 4 | 0 | 5 | 15 | 6 |
| C-2 | HR | 95 | 5 | 0 | 14 | 31 | 10 |
| D-1 | HR | 93 | 7 | 0 | 10 | 22 | 7 |
| E-1 | HR | 91 | 9 | 0 | 7 | 14 | 7 |
| E-2 | HR | 94 | 0 | 6 | 7 | 28 | — |
| E-3 | HR | 91 | 0 | 9 | 10 | 11 | — |
| F-1 | HR | 90 | 10 | 0 | 8 | 21 | 6 |
| G-1 | HR | 96 | 4 | 0 | 9 | 13 | 5 |
| G-2 | HR | 79 | 19 | 2 | 9 | 19 | 14 |
| H-1 | GA | 93 | 7 | 0 | 8 | 18 | 7 |
| I-1 | GI | 97 | 3 | 0 | 6 | 16 | 5 |
| a-1 | HR | 94 | 0 | 6 | 5 | 6 | — |
| b-1 | HR | 97 | 0 | 3 | 19 | 23 | — |
| c-1 | HR | 97 | 3 | 0 | 3 | 5 | 1 |
| d-1 | HR | 85 | 15 | 0 | 12 | 25 | 10 |
| e-1 | HR | 92 | 8 | 0 | 8 | 15 | 6 |
| f-1 | HR | 92 | 4 | 4 | 5 | 16 | 7 |
| g-1 | HR | 99 | 0 | 1 | 8 | 14 | — |
| h-1 | HR | 89 | 11 | 0 | 7 | 11 | 3 |
| k-1 | HR | 88 | 12 | 0 | 9 | 14 | 4 |
| l-1 | HR | 76 | 0 | 24 | 13 | 18 | — |
| m-1 | HR | 98 | 2 | 0 | 19 | 25 | 4 |

| Steel | Maximum circle-equivalent diameter of martensite (μm) | YP (MPa) | TS (MPa) | YR (%) | El (%) | λ (%) | Fatigue limit ratio | Si scale pattern | Note |
|---|---|---|---|---|---|---|---|---|---|
| A-1 | 9 | 442 | 639 | 69 | 29 | 87 | 0.52 | Absent | Invention Steel |
| A-2 | 12 | 463 | 604 | 77 | 28 | 107 | 0.50 | Absent | Invention Steel |
| A-3 | 7 | 544 | 661 | 82 | 22 | 124 | 0.42 | Absent | Comparative Steel |
| A-4 | 18 | 487 | 670 | 73 | 33 | 67 | 0.53 | Absent | Comparative Steel |
| A-5 | 12 | 536 | 618 | 87 | 24 | 109 | 0.44 | Absent | Comparative Steel |
| B-1 | 14 | 480 | 598 | 80 | 34 | 100 | 0.50 | Absent | Invention Steel |
| B-2 | 3 | 551 | 637 | 86 | 23 | 125 | 0.47 | Absent | Comparative Steel |
| B-3 | 11 | 519 | 625 | 83 | 25 | 85 | 0.44 | Absent | Comparative Steel |
| C-1 | 14 | 450 | 626 | 72 | 24 | 114 | 0.47 | Absent | Invention Steel |
| C-2 | 19 | 488 | 679 | 72 | 29 | 56 | 0.51 | Absent | Comparative Steel |
| D-1 | 13 | 426 | 646 | 66 | 25 | 80 | 0.50 | Absent | Invention Steel |
| E-1 | 10 | 422 | 604 | 70 | 33 | 83 | 0.52 | Absent | Invention Steel |
| E-2 | — | 535 | 680 | 79 | 32 | 120 | 0.41 | Absent | Comparative Steel |
| E-3 | — | 489 | 588 | 83 | 25 | 117 | 0.40 | Absent | Comparative Steel |
| F-1 | 14 | 634 | 801 | 79 | 24 | 91 | 0.52 | Absent | Invention Steel |
| G-1 | 9 | 489 | 671 | 73 | 32 | 125 | 0.50 | Absent | Invention Steel |

TABLE 3-continued

| Microstructure and mechanical properties | | | | | | | | | |
|---|---|---|---|---|---|---|---|---|---|
| G-2 | 21 | 524 | 844 | 62 | 26 | 33 | 0.50 | Absent | Comparative Steel |
| H-1 | 16 | 408 | 659 | 62 | 25 | 82 | 0.47 | Absent | Invention Steel |
| I-1 | 12 | 477 | 672 | 71 | 24 | 112 | 0.48 | Absent | Invention Steel |
| a-1 | — | 486 | 591 | 89 | 25 | 61 | 0.43 | Absent | Comparative Steel |
| b-1 | — | 500 | 652 | 77 | 34 | 59 | 0.44 | Absent | Comparative Steel |
| c-1 | 3 | 501 | 592 | 85 | 31 | 81 | 0.48 | Absent | Comparative Steel |
| d-1 | 24 | 493 | 689 | 72 | 22 | 47 | 0.48 | Absent | Comparative Steel |
| e-1 | 12 | 431 | 659 | 65 | 27 | 82 | 0.49 | Present | Comparative Steel |
| f-1 | 8 | 399 | 561 | 71 | 33 | 84 | 0.46 | Absent | Comparative Steel |
| g-1 | — | 367 | 535 | 69 | 35 | 144 | 0.47 | Absent | Comparative Steel |
| h-1 | 5 | 517 | 720 | 72 | 22 | 69 | 0.48 | Absent | Comparative Steel |
| k-1 | 7 | 456 | 662 | 69 | 23 | 63 | 0.52 | Absent | Comparative Steel |
| l-1 | — | 446 | 545 | 82 | 27 | 136 | 0.44 | Absent | Comparative Steel |
| m-1 | 8 | 432 | 574 | 75 | 31 | 46 | 0.45 | Absent | Comparative Steel |

Underlined values indicate that the values are outside the range of the present invention.

*HR indicates a hot-rolled steel sheet, GI indicates a hot-dip galvanized steel sheet, GA indicates an alloyed hot-dip galvanized steel sheet on a hot-rolled steel sheet.

INDUSTRIAL APPLICABILITY

According to the present invention, it is possible to provide a hot-rolled steel sheet having no Si scale patterns on the surface, that is, having excellent surface properties and having excellent fatigue resistance, shape fixability, and hole expansibility.

In addition, when the hot-rolled steel sheet of the present invention is used, working during press forming or the like becomes easy, and it becomes possible to manufacture car suspension components and the like having favorable designability. Therefore, the hot-rolled steel sheet of the present invention extremely significantly contributes to industries.

The invention claimed is:

1. A hot-rolled steel sheet comprising: by mass %,

C: 0.02% to 0.20%;
Si: more than 0% to 0.15%;
Mn: 0.5% to 2.0%;
P: more than 0% to 0.10%;
S: more than 0% to 0.05%;
Cr: 0.05% to 0.5%;
Al: 0.01% to 0.5%;
N: more than 0% to 0.01%;
Ti: 0% to 0.20%;
Nb: 0% to 0.10%;
Cu: 0% to 2.0%;
Ni: 0% to 2.0%;
Mo: 0% to 1.0%;
V: 0% to 0.3%;
Mg: 0% to 0.01%;
Ca: 0% to 0.01%;
REM: 0% to 0.1%; and
B: 0% to 0.01%, with a remainder consisting of Fe and impurities, in which amounts of Cr and Al added satisfy Expression (1) below, wherein a metallographic structure has, by % by volume, a ferrite fraction of more than 90% and 98% or less, a martensite fraction of 2% to less than 10%, and, furthermore, a fraction of a residual structure made of one or more of pearlite, bainite, and residual austenite being less than 1%, the ferrite has an average circle-equivalent diameter of 4 μm or more and a maximum circle-equivalent diameter of 30 μm or less, and the martensite has an average circle-equivalent diameter of 6 μm or more and 10 μm or less and a maximum circle-equivalent diameter of 20 μm or less, where a tensile strength is 590 MPa or more:

$$[Cr]\times 5+[Al]\geq 0.50 \qquad \text{Expression (1)}$$

here, in Expression (1), [Cr] represents an amount of Cr (mass %), and [Al] represents an amount of Al (mass %).

2. The hot-rolled steel sheet according to claim 1, further comprising:

by mass %, one or two of
Ti: 0.02% to 0.20%; and
Nb: 0.005% to 0.10%.

3. The hot-rolled steel sheet according to claim 1, further comprising:

by mass %, one or more of
Cu: 0.01% to 2.0%;
Ni: 0.01% to 2.0%;
Mo: 0.01% to 1.0%; and
V: 0.01% to 0.3%.

4. The hot-rolled steel sheet according to claim 1, further comprising:

by mass %, one or more of
Mg: 0.0005% to 0.01%;
Ca: 0.0005% to 0.01%; and
REM: 0.0005% to 0.1%.

5. The hot-rolled steel sheet according to claim 1, further comprising:

by mass %,

B: 0.0002% to 0.01%.

6. The hot-rolled steel sheet according to claim 1, further comprising:

by mass %, one or more of

Ti: 0.02% to 0.20%;

Nb: 0.005% to 0.10%;

Cu: 0.01% to 2.0%;

Ni: 0.01% to 2.0%;

Mo: 0.01% to 1.0%;

V: 0.01% to 0.3%;

Mg: 0.0005% to 0.01%;

Ca: 0.0005% to 0.01%;

REM: 0.0005% to 0.1%; and

B: 0.0002% to 0.01%;

V: 0.01% to 0.3%;

Mg: 0.0005% to 0.01%;

Ca: 0.0005% to 0.01%;

REM: 0.0005% to 0.1%; and

B: 0.0002% to 0.01%.

* * * * *